US005390604A

United States Patent [19]

Ingersoll

[11] Patent Number: 5,390,604

[45] Date of Patent: Feb. 21, 1995

[54] METHOD OF AND APPARATUS FOR MORTAR FUZE APEX ARMING

[75] Inventor: Philip F. Ingersoll, Grosse Pointe, Mich.

[73] Assignee: The United States of America as represented by the Secretary of the Army, Washington, D.C.

[21] Appl. No.: 172,784

[22] Filed: Dec. 27, 1993

[51] Int. Cl.[6] ..... F42C 15/40

[52] U.S. Cl. ..... 102/211; 102/215; 102/221

[58] Field of Search ..... 102/200, 206, 211, 215, 102/221; 342/166

[56] References Cited

U.S. PATENT DOCUMENTS

| | | | |
|---|---|---|---|
| 3,750,583 | 8/1973 | White et al. | 102/221 |
| 4,214,533 | 7/1980 | Fine et al. | 102/209 |
| 4,280,355 | 7/1981 | Donnally et al. | 73/5 |
| 4,375,192 | 3/1983 | Yates et al. | 102/215 |
| 4,773,328 | 9/1988 | Germershausen et al. | 102/214 |
| 4,782,757 | 11/1988 | Carter | 102/394 |

*Primary Examiner*—Ian J. Lobo

*Attorney, Agent, or Firm*—Freda L. Krosnick; Charles H. Harris

[57] ABSTRACT

A method of and system for mortar fuze apex arming is disclosed in which a microprocessor circuit is added to the M734 class of mortar proximity fuzes such that, at launch, the microprocessor measures the turbine-alternator frequency and the Doppler frequency and uses those values to calculate or look up the charge and angle used by the gunner firing the mortar as well as the time of flight to the trajectory apex, based on stored firing table or equation information. The microprocessor then causes the electrical arming of the fuze at the apex of the flight of the mortar round, using existing arming circuits already present in the M734 class of mortar proximity fuzes. Alternatively, the microprocessor may cause the electrical arming of the fuze just prior to the desired height of burst for the mortar round.

16 Claims, 2 Drawing Sheets

SIG
C1
R1
C2
R2
C3
R4
R3
IC2
IC1
C4
+VDD
R7
CR2
R8
C5
C8
R22
IMP. FUNCTION
R9
NSB
OSC B+
GND
AC-1
AC-2
CR4
C10
VR1
R20
C9
R21
Q3
R17
R18
R19
Q2
VR2
VDD
VSS
FIRE PULSE
TO MECHANICAL SAFETY AND ARMING 208
200
μp
C6
R15
R16
C7
S1
R10
R11
CR3
Q1
R12
R13

METHOD OF AND APPARATUS FOR MORTAR FUZE APEX ARMING

BACKGROUND OF THE INVENTION

The present invention relates generally to the arming of fuzes used with artillery shells. More particularly, the present invention relates to a method of and apparatus for arming a mortar proximity fuze at the apex of the trajectory of the mortar shell.

At the present time, the M734 mortar proximity fuze arming is controlled by a setback sensor and the turbine alternator, both of which components form part of the mortar. At the time the mortar round is launched, the set-back sensor detects a valid launch condition and removes one lock from the safety system. Gears in the safety and arming device then count the turns of the turbine-alternator rotor and withdraw the second safety lock after approximately 1,000 turns. After the second safety lock has been withdrawn, the safety and arming device rotor moves into the "armed" position and the mortar round is then armed to explode at a predetermined height above its target.

In mortar rounds which utilize electronic arming, such systems are based on a simple analog timer. Approximately 2.5 seconds after the turbine-alternator starts providing power, the electronic arming circuits are "armed" and ready to fire the warhead at the predetermined height above the target.

The known methods and apparatus for arming mortar proximity fuzes function to arm the mortar fuze shortly after the round is launched. Once the fuze is armed, it is intended to explode without hurting the launch crew. However, since the fuze is a simple and low-cost Doppler fuze, it is vulnerable to system and environmental noise that can cause explosions of the round before it reaches its predetermined altitude. While production fuzes easily meet the design specifications of less than 1 percent above 30 feet over the target, premature explosions shortly after firing from the mortar tube have an adverse psychological impact on the troops using the mortar rounds.

In contrast to the known prior art methods and apparatus, the present invention utilizes a method of and system for avoiding the early explosion of the mortar round before it has reached the apex of its trajectory by not electrically arming the fuze until it is halfway through its expected flight time. The instant invention thus serves to decrease the chance of an early explosion of the round by 50 percent and therefore improves the perceived "goodness" of the fuze with a consequent beneficial psychological impact on the troops using the mortar round.

SUMMARY AND OBJECTS OF THE INVENTION

In view of the foregoing, it should be apparent that there still exists a need in the art for a method of and system for arming mortar proximity fuzes in a controlled manner such that the mortar cannot explode until it has reached its designed altitude and distance over the target. It is, therefore, a primary object of this invention to provide a method of and system for reducing the possibility of the explosion of a mortar round before its designed altitude by not arming its proximity fuze until after the mortar round reaches at least the apex of its flight.

More particularly, it is an object of this invention to provide a method of and system for mortar fuze apex arming as aforementioned having simple and reliable electronic circuitry which does not require alignment nor costly components.

Still more particularly, it is an object of this invention to provide a method of and system for mortar fuze apex arming which utilizes a microprocessor added to the existing circuitry used within an M734 mortar proximity fuze in order to arm the mortar fuze after the mortar round has reached the apex of its flight.

Another object of the present invention is to provide a reliable and relatively inexpensive method of and system for arming a mortar fuze after the mortar round has reached the apex of its flight.

Briefly described, these and other objects of the invention are accomplished in accordance with its system aspects by providing an inexpensive microprocessor which is connected to the existing mortar fuze circuitry such that it receives the Doppler frequency and turbine-alternator frequency signals from that circuitry, uses stored firing tables to determine the time to the apex of the flight of the mortar round and then calculates the time from mortar launch to reach the apex and uses the result of that calculation to control the electronic arming of the fuze.

In its method aspects, the mortar fuze apex arming system of the present invention measures the turbine-alternator frequency and Doppler frequency at launch generated by the existing M734 mortar proximity fuze circuitry. A calculation is then made of the charge and angle used by the gunner firing the mortar round, and the time of flight of the mortar round to its trajectory apex is determined. Based upon the time of flight information, the mortar fuze apex arming system of the present invention then electronically arms the fuze at the apex of the flight of the mortar round, using existing arming circuits present in the M734 proximity fuze.

Alternatively, the mortar fuze apex arming method and system of the present invention can be used to arm the fuze just before the desired height of burst of the mortar round. That would be accomplished by determining the total expected time of the flight of the mortar round and then using that information to arm the fuze at the appropriate time.

With these and other objects, advantages and features of the invention that may become hereinafter apparent, the nature of the invention may be more clearly understood by reference to the following detailed description of the invention, the appended claims and to the several drawings attached herein.

DETAILED DESCRIPTION OF THE PREFERRED EMBODIMENT

Figure 1:
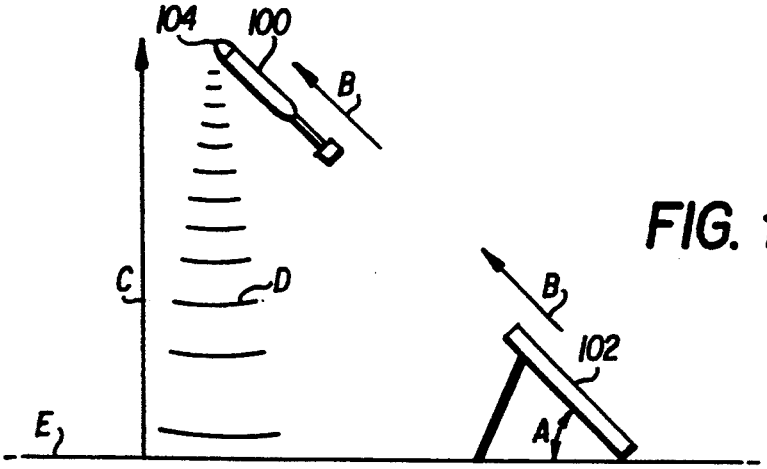
FIG. 1 is a drawing showing generally how the apex of a mortar round is determined.

Referring now in detail to the drawings wherein like parts are designated by like reference numerals throughout, there is shown in FIG. 1 an illustration of the methodology for generating the signals used to determine the apex of a mortar equipped with an M734 proximity fuze. As shown in FIG. 1, the mortar round 100 leaves the mortar tube 102 at a predetermined angle A which is determined by the gunner using the mortar round 100 based upon the distance of the target the mortar round is to hit. In addition, the gunner also needs to determine the charge or number of increments of powder charge that are to be used with the mortar round 100 at the angle A in order to reach the target. In order to assist the gunner in determining the proper angle and charge to use in order to reach the desired target, all of the characteristics of the mortar flight, such as the range or distance, the time of the flight, the apex height, etc., are contained in firing tables which the gunner uses to fire the mortar.

At the launch of the mortar round 100, the turbine-alternator begins measuring the velocity of the air flow into the fuze hose 104 of the mortar round 100. The velocity of the air flow into the fuze nose 104 is directly related to the velocity of the mortar shell 100. In addition, the initial speed of the turbine 204 is related to the charge or number of powder charges or increments used to fire the mortar. The frequency of the voltage generated by the turbine-alternator 204 is controlled by the number of poles in the alternator structure in a known manner and is therefore directly related to the rotational speed of the turbine-alternator 204. Thus, the frequency of the turbine-alternator voltage is a function of the air speed of the mortar round 100, which is a known function for the alternators 204 used in the M734 class of mortar fuzes. By measuring the turbine-alternator frequency for a predetermined period of time, the flight distance B can readily be calculated.

In the M734 transmitter/receiver 202 the transmitter is connected directly to the output of the turbine-alternator 204, which provides the power supply for operating that transmitter/receiver 202. Thus, the transmitter/receiver starts transmitting as soon as the mortar round 100 comes out of the mortar tube 102. Although the transmitter/receiver 202 signal is not used until later in the flight of the mortar, that is, after the mechanical arming of the safety and, arming mechanism, it is present and available from the launch of the mortar round 100. The transmitter/receiver 202 of the M734 mortar fuze uses a Doppler processor to measure the rate of change in vertical distance between the fuze 104 and the target E which is the ground in most instances. The Doppler waves generated by the transmitter and then received back at the receiver after reflecting off of the target E produce a Doppler signal which changes in amplitude as the fuze 104 nears the ground. That Doppler signal forms the basis for the proximity function of the fuze 104.

Each cycle of the Doppler frequency is a measure of the distance D that the fuze 104 has moved relative to the target E during the period of the cycle. Thus, the phase of the frequency is controlled by the distance to the target E such that one cycle of Doppler frequency represents "X" meters where X is one-half the radio frequency wavelength of the transmitter. Therefore, one cycle of the-Doppler frequency represents a change one wavelength in distance from the fuze 104 to the target E and then back to the fuze 104. Since the transmitter turns on at the moment the mortar 100 is launched, it provides a signal which is a measure of the vertical distance of the fuze 104 to the ground E. Such Doppler signal is called the "going away Doppler".

Thus, right after the mortar 100 is launched from the mortar tube 102, the signal produced by the turbine-alternator 204 measures the velocity or distance B along its trajectory. The Doppler signal produced by the transmitter/receiver 202 measures the vertical velocity or distance of the mortar round 100 from the ground E. Using those two signals in Equation (1) provides the information needed to calculate the launch angle A of the mortar round 100.

$$\text{Angle } A = \text{Sin}^{-1}\left(\frac{\text{Vertical Distance } C}{\text{Flight Distance } B}\right) \tag{1}$$

Figure 2:
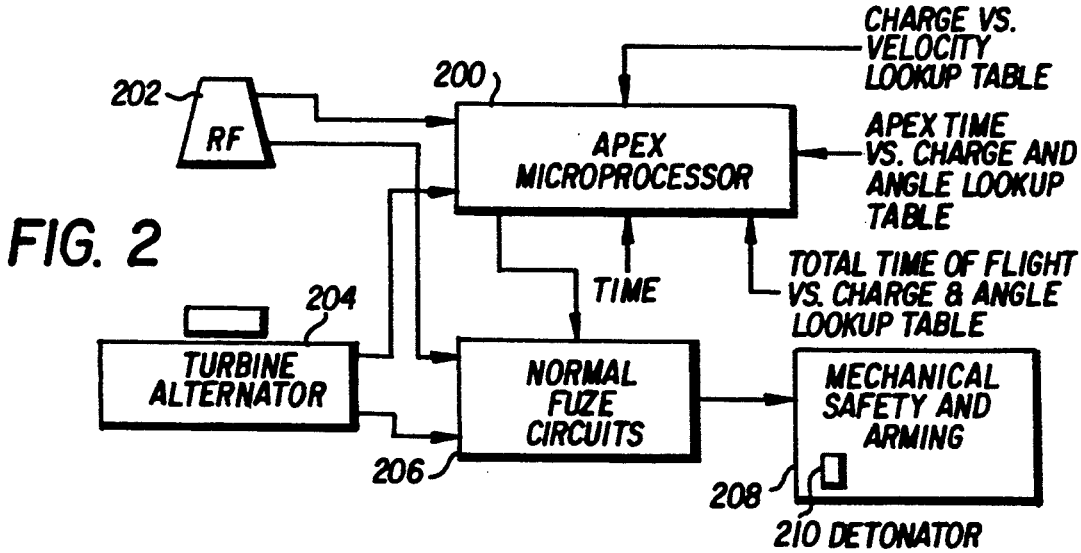
FIG. 2 is a block diagram of the electronic circuits used by the present invention to determine the apex of a mortar round.

Referring now to FIG. 2, there is shown in block diagram form the mortar fuze apex arming system of the present invention. An inexpensive microprocessor or microcontroller 200, such as Model No. DS5000-08-08, available from Dallas Semiconductor of Addison, Tex., is connected to receive the alternator voltage from the turbine-alternator 204, as well as the Doppler signal from the RF transmitter/receiver 202. The transmitter/receiver 202 and turbine-alternator 204 each provide their respective signals to the normal fuze circuits 206 present in the M734 class of mortar fuzes. As is also the current standard in the M734 class of mortar fuzes, the fuze circuits 206 are connected to the mechanical safety and arming mechanism 208 which includes the detonator 210.

The microprocessor 200 includes two look-up tables in its on-board memory. Using the alternator voltage signal generated by the turbine-alternator 204, a first look-up table allows the microprocessor 200 to determine the charge used with the mortar round 100, based upon the velocity of the mortar round 100. The time after launch is also input into the microprocessor 200 as, for example, a function of the time the microprocessor has been receiving power or as a function of the time that the RF transmitter/receiver 202 has been on, or both. Using that information, the angle of the mortar tube 102 is calculated in accordance with Equation (1) and then the apex time is determined by using a second look-up table.

Alternatively, the microprocessor 200 can merely look up the charge and angle used by the gunner, if such information is stored in its on-board memory. Based upon the time of flight to the trajectory apex of the mortar round 100, the microprocessor 200 would then electronically arm the fuze of the mortar 100 at the apex of the flight, by causing the fuze circuits 206 to arm the mechanical safety and arming mechanism 208 at the apex of the flight of the mortar round 100.

Using the present invention, the M734 class of mortar proximity fuzes require no mechanical changes and only the addition of a microprocessor to the existing circuitry in order to eliminate the premature arming and consequent explosions of mortar rounds. In addition, the present invention can also be used to arm the fuze of the mortar 100 just before the fuze is to perform its function in order to further to reduce the chance of early explosions of the mortar round 100. In that case, the microprocessor 200 would either calculate or look-up the total expected time of the flight of the round 100 based upon the calculated or looked-up charge and angle and then set the time for turning on the fuze circuits 206 and therefore activating the arming mechanism 208 of the mortar round 100 just before the desired height of burst.

It will also be obvious to those of ordinary skill in the art that the instant mortar fuze apex arming system of the present invention can be adapted for use with other types of artillery shells besides mortars. For example, artillery shells also utilize mechanical fuze systems for their operation. Such systems consist of a similar sating and arming device which requires the mechanical sensing of the set back or direction of travel of the artillery shell and the centrifugal spin forces affecting the artillery shell, as, for example, by weight and springs which function to mechanically permit the safety and arming mechanism to arm the shell if the acceleration forces are sustained for a predetermined period of time.

Figure 3:
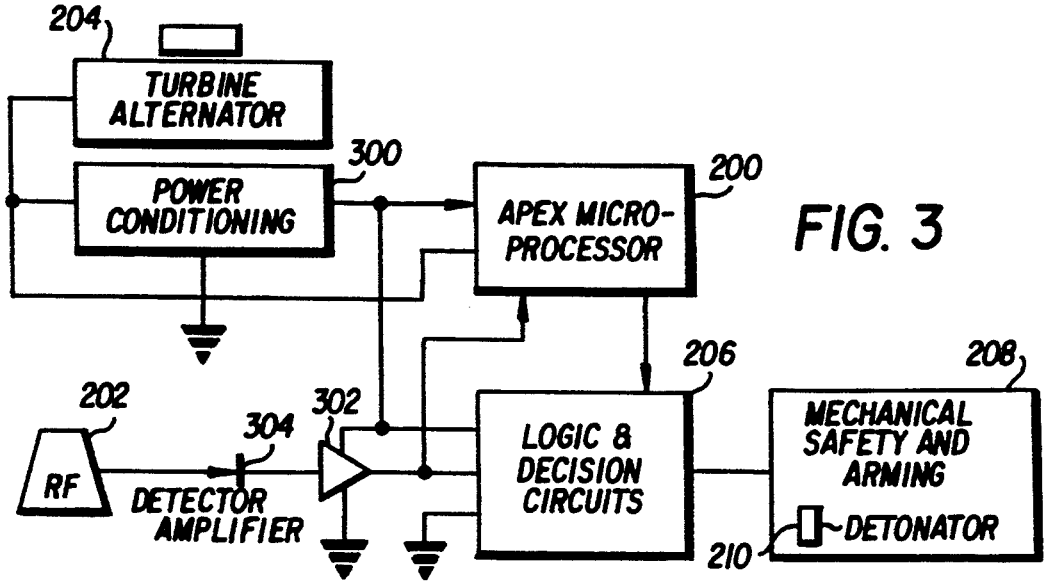
FIG. 3 is a block diagram of the mortar fuze circuit used with the mortar fuze apex arming system of the present invention.

Referring now to FIG. 3, there is shown a schematic block diagram of the circuits utilized to operate the mortar fuze apex arming system of the present invention. As previously discussed, the turbine-alternator 204, upon the launch of the mortar round 100, begins generating a voltage. That voltage is rectified and conditioned by the power conditioning circuit 300 and is then used to power all of the other components of the mortar fuze apex arming system of the present invention as shown, for example, in FIG. 3. The output from the turbine-alternator 204 is also fed as the distance or velocity signal to the microprocessor 200, as previously described.

The RF transmitter/receiver 202, which is also powered by the turbine-alternator 204 through the power conditioning circuit 300, generates the Doppler signal as discussed above which is representative of the vertical distance to the target E. That signal is generated in the detector 304, amplified by the amplifier 302 and then input to both the microprocessor 200 and the logic and decision circuitry 206.

Figure 4:
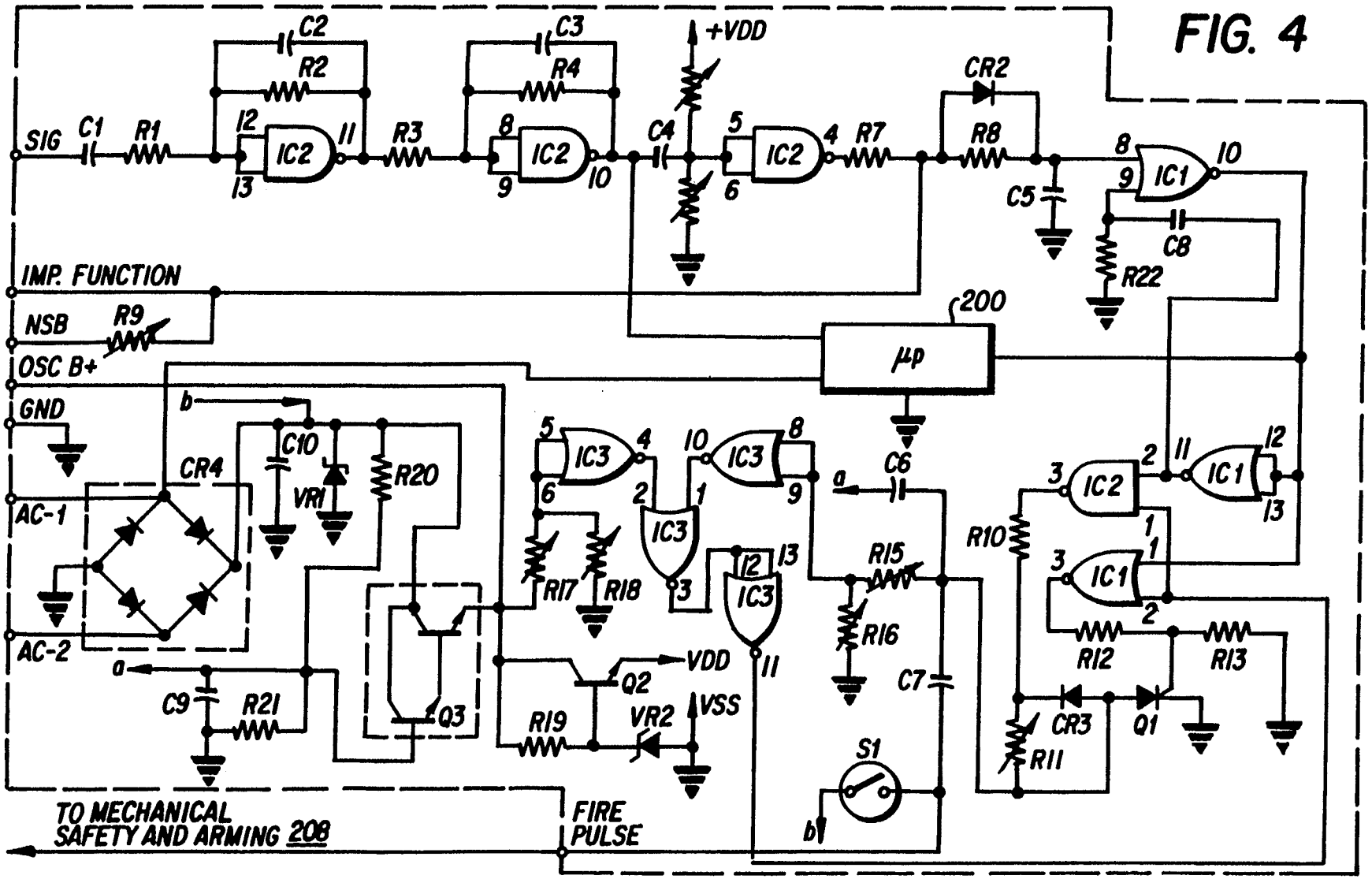
FIG. 4 is an electronic schematic diagram of the circuitry used with the mortar fuze apex arming system of the present invention.

The output from the microprocessor 200 is input to the existing M734 mortar proximity fuze logic and decision circuitry 206. The output from the logic and decision circuitry 206 is connected to the mechanical safety and arming mechanism 208 which contains the detonator 210. FIG. 4 shows an electrical schematic diagram of the instant mortar fuze apex arming system which includes the outputs AC-1 and AC-2 from the turbine-alternator 204, the power conditioning circuitry 300 which is formed primarily by a full wave bridge rectifier, the microprocessor 200, the amplifier 302, the detector 304 and the logic and decision circuitry 206.

Although only a preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. A method for electronically arming a proximity fuze in an artillery shell, comprising the steps of:

measuring the velocity of said artillery shell at a predetermined time after launching said artillery shell;

measuring the elapsed time since launching said artillery shell to said predetermined time;

calculating the flight distance travelled by said artillery shell since launch at said predetermined time;

measuring the vertical distance to ground of said artillery shell at said predetermined time;

determining the powder charge and angle of firing of said artillery shell using said calculated flight distance and measured vertical distance;

determining the apex of the travel trajectory of said artillery shell using said determined powder charge and angle of firing of said artillery shell; and arming said proximity fuze when said artillery shell reaches the apex of its travel trajectory.

2. A method for electronically arming a proximity fuze in an artillery projectile comprising the steps of:

mounting a turbine-alternator in said artillery projectile for measuring the velocity of said artillery projectile and generating a voltage signal whose frequency is directly related to artillery projectile velocity;

mounting a transmitter/receiver and a Doppler processor in said artillery projectile;

using said Doppler processor for measuring the rate of change in distance between a target and said artillery projectile and producing a Doppler signal representative of said rate of change in distance;

calculating the apex of flight of said artillery projectile using said voltage and Doppler signals; and arming said proximity fuze when said artillery projectile has reached said apex of flight.

3. Apparatus for electronically arming a proximity fuze in an artillery shell, comprising:

means for producing a velocity signal indicative of the velocity of said artillery shell at a predetermined time after its launch;

means for producing a Doppler signal indicative of the vertical distance of said artillery shell to ground at said predetermined time; and digital data processing means for calculating the elapsed time after launch to said predetermined time, for receiving said velocity and Doppler signals and for determining the apex of the travel trajectory of said artillery shell, said digital data processing means further generating an arming signal for arming said proximity fuze when said artillery shell reaches said apex of its travel trajectory.

4. The method of claim 1, wherein said step of measuring the elapsed time is accomplished using a signal generated while measuring the vertical distance to ground of said artillery shell.

5. The method of claim 1, wherein said steps of calculating the flight distance travelled, determining the powder charge and angle of firing and determining the apex of the travel trajectory are all accomplished using look-up tables.

6. The method of claim 1, wherein said steps of measuring the elapsed time, calculating the flight distance, determining the powder charge and angle of firing and determining the apex of the travel trajectory are performed by a digital data processor.

7. The method of claim 1, wherein said step of measuring the vertical distance to ground generates a Doppler signal whose presence is used to determine the elapsed time of flight of said artillery shell.

8. The method of claim 1, wherein said step of determining the apex of the travel trajectory comprises the step of determining the time of flight of said artillery shell.

9. The method of claim 2, wherein the presence of said Doppler signal is used to determine the elapsed time of flight of said artillery projectile.

10. The method of claim 2, wherein said step of calculating said apex of flight of said artillery projectile comprises the steps of:

determining the charge and firing angle used with said artillery projectile using said velocity signal;

determining the time to reach said apex of flight using said charge and firing angle information; and determining the total time of flight of said artillery projectile using said charge and firing angle information.

11. The method of claim 10, wherein said step of determining the firing angle is accomplished using said voltage and Doppler signals.

12. The method of claim 2, wherein said step of calculating said apex of flight of said artillery projectile is performed by a digital data processor.

13. The apparatus of claim 3, wherein said means for producing a velocity signal comprises a turbine-alternator carried by said artillery shell.

14. The apparatus of claim 3, wherein said means for producing a Doppler signal comprises a transmitter-receiver carried by said artillery shell.

15. The apparatus of claim 3, wherein receipt of said Doppler signal by said digital data processing means is used to calculate said elapsed time after launch.

16. The apparatus of claim 3, wherein said digital data processing means contains look-up tables for determining at least one of the charge of said artillery shell, the apex of the travel trajectory of said artillery shell and the total time of flight of said artillery shell.

* * * * *